US005622118A

United States Patent [19]

Rowan

[11] Patent Number: 5,622,118

[45] **Date of Patent: *Apr. 22, 1997**

[54] CONVERTIBLE SUPPORT APPARATUS

[76] Inventor: Thomas J. Rowan, 3360 Bishop St., 2nd Floor, Cincinnati, Ohio 45220

[ * ] Notice: The term of this patent shall not extend beyond the expiration date of Pat. No. 5,425,313.

[21] Appl. No.: 492,667

[22] Filed: Jun. 20, 1995

Related U.S. Application Data

[63] Continuation-in-part of Ser. No. 93,082, Jun. 16, 1993, Pat. No. 5,425,313.

[51] Int. Cl.[6] ..... A47B 1/00

[52] U.S. Cl. ..... 108/65; 108/140

[58] Field of Search ..... 108/70, 65, 71, 108/73, 74, 76, 77, 78, 84

[56] References Cited

U.S. PATENT DOCUMENTS

| | | | |
|---|---|---|---|
| 1,342,481 | 6/1920 | Wennerstrom . | |
| 1,475,401 | 11/1923 | Leatherman et al. . | |
| 1,729,221 | 9/1929 | Krema . | |
| 1,742,904 | 1/1930 | Follmer . | |
| 1,777,683 | 10/1930 | Starker . | |
| 1,963,467 | 6/1934 | Keller . | |
| 2,102,449 | 12/1937 | Zimmerman | 108/84 X |
| 2,132,515 | 10/1938 | Oppenheimer . | |
| 2,293,496 | 8/1942 | Egger . | |
| 2,456,835 | 12/1948 | Nash | 108/76 X |
| 2,468,473 | 4/1949 | Underwood . | |
| 2,605,153 | 7/1952 | Lietz . | |
| 2,680,661 | 6/1954 | Bremer . | |
| 2,891,679 | 6/1959 | Maupin . | |
| 3,224,391 | 12/1965 | Cooper . | |
| 4,365,561 | 12/1982 | Tellier et al. . | |
| 5,425,313 | 6/1995 | Rowan | 108/65 |

FOREIGN PATENT DOCUMENTS

| | | |
|---|---|---|
| 57438 | 3/1940 | Denmark . |
| 81621 | 1/1957 | Denmark . |
| 1236888 | 6/1960 | France . |
| 83934 | 3/1895 | Germany . |
| 2234647 | 1/1974 | Germany . |
| 0043299 | 4/1977 | Japan . |
| 288354 | 5/1953 | Switzerland . |
| 409305 | 4/1934 | United Kingdom . |

*Primary Examiner*—Jose V. Chen

*Attorney, Agent, or Firm*—Wood, Herron and Evans, P.L.L.

[57] ABSTRACT

A convertible support apparatus, such as a table, which has an expandable upper support surface. The convertible support apparatus is comprised of overlying and underlying support members which are connected by a pivot pin. The overlying and underlying support members slide along a stationary support to center the weight of the expanded apparatus after or during rotation of the overlying support member to a position adjacent the underlying support member. The overlying support member then drops down to a position in which the upper support surfaces of the two support members are generally flush.

25 Claims, 6 Drawing Sheets

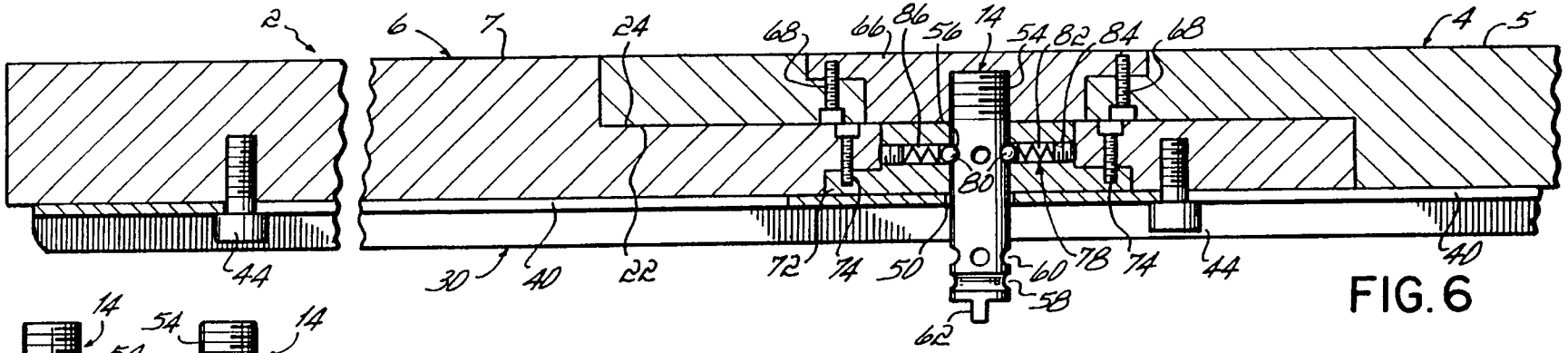
FIG. 6
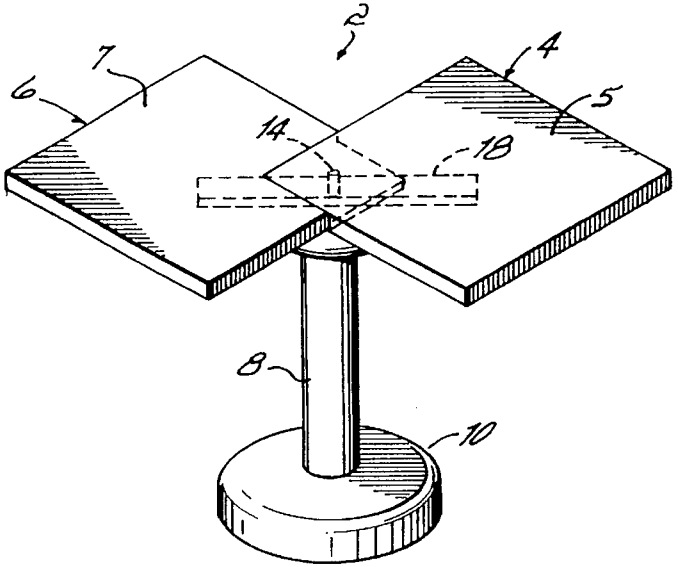
FIG. 9
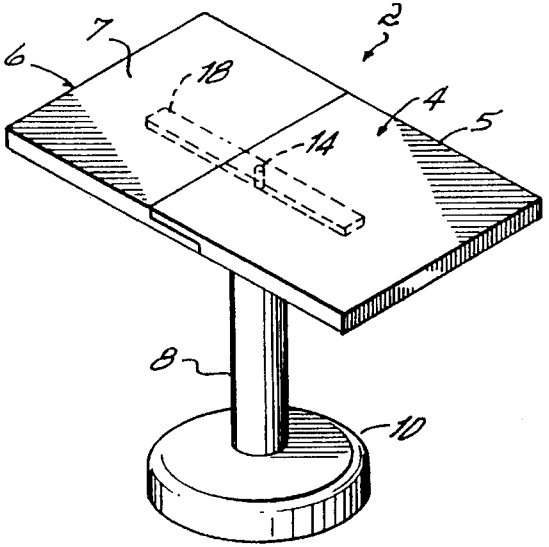
FIG. 8
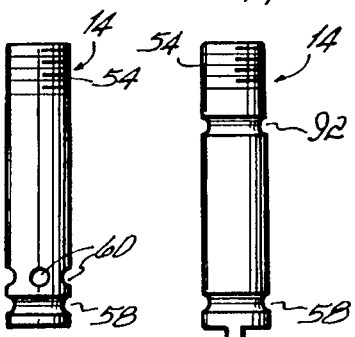
FIG. 7A
FIG. 7B
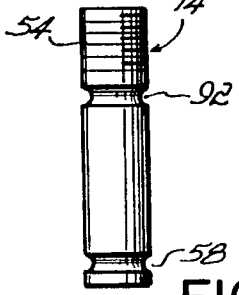
FIG. 7C

CONVERTIBLE SUPPORT APPARATUS

This application is a continuation-in-part of U.S. patent application Ser. No. 08/093,082 filed Jun. 16, 1993, now U.S. Pat. No. 5,425,313, the disclosure of which is hereby fully incorporated by reference herein.

FIELD OF THE INVENTION

The invention relates to an improved support apparatus for use in environments such as the home, office, restaurants, work shops or retail establishments, and which permits ready expansion of an upper support surface.

BACKGROUND OF THE INVENTION

In such environments as restaurants, homes, retail stores, offices and work shops, there arises the need on occasion to expand available support top capacity, work surface capacity or table top space. When this need arises, one manner of addressing the problem is merely to employ an additional, separate support apparatus having the additional support area which is necessary. However, this option initially requires the purchase of the additional support apparatus which will be used only occasionally, and further requires that there be sufficient space to store such additional support apparatus when not in use.

In the case of tables, some may be expanded in upper surface area by adding additional leaves to the table, typically by opening the table to expose a gap which can receive one or more of the leaves. Again, however, the leaves must be purchased and stored. As a further alternative, the available table surface area can be increased by use of convertible tables having double thickness table surface members which are hinged along one end to allow the member to be opened, thereby exposing the additional table surface. This last type of convertible table requires a secure attachment along the hinge line to permit repeated openings without breakage, and requires additional means to provide support for the opened section. In all the above examples, the expanded table surface is typically limited to a rectangular shape because of the restraints in constructing these types of convertible tables.

It would therefore be desirable to provide a support apparatus having an easily expandable upper support surface having a large number of possible surface and base configurations and a large number of potential applications.

SUMMARY OF THE INVENTION

The invention relates to an improved convertible support apparatus, such as an item of furniture, which can provide an expanded upper support surface area. The support apparatus includes overlying and underlying support members which are connected together through a pivot pin, permitting the overlying support member to be rotated relative to the underlying support member to expose an upper support surface of the underlying support member. After or while the overlying support member is rotated to a position adjacent the underlying support member, both support members are moved along a slide attached to a stationary support so that the weight of the expanded support surface is centered over the stationary support. When in this centered position, the pivot pin and overlying support member drop down into a fixed position with the upper support surfaces of the two support members being at least generally flush. The pivot pin is spaced from the center of gravity of the overlying and underlying table members, typically adjacent an edge, so that the rotation is able to advantageously expose the maximum amount of additional surface area of the underlying member.

In the case where the support apparatus is a table, the respective overlying and underlying support members are table tops which may have the same shape and dimension or may be different in shape and/or dimension. The most aesthetically pleasing appearance for the expanded table is a generally flush surface as mentioned above. To achieve this in the first embodiment, the upper surface of the underlying table member in the vicinity of the pivot pin and the corresponding lower surface of the overlying table member in the vicinity of the pin may be constructed in such a manner that, when the overlying table member is rotated to a predetermined point between 0 and 180 degrees of rotation, typically 180 degrees, the overlying table member is able to drop into position over the mating underlying table member section to generate a flush expanded table surface. However, full downward travel of the pivot pin is prevented due to a restriction all along the slide attached to the stationary support, except at the center of the slide. This restriction, except at the center, aids in guiding the weight of the expanded table surface to a centered position over the support to optimize stability. At the center point is an aperture having a diameter which will accept the pivot pin and permit full downward travel. When the expanded table is slid along the slide to that point where the pivot pin is over the aperture at the center of gravity, the pin will drop through the aperture, creating the flush surface appearance, and also centering the expanded table surface weight.

Also in the first embodiment of the invention, the overlying support or table member is restrained from rotating freely about the pivot pin by a mechanism comprised of detent cavities formed in the pivot pin which mate with restraining members directed inwardly from the periphery of the aperture in the underlying table member. One such type of restraining member is a ball plunger which applies an inward force on a ball bearing from a mounted spring to engage a single detent cavity in the pivot pin. At least one such restraining member should be used when restricting rotation of the pivot pin in this manner. Typically, four restraining members such as the ball plungers mentioned above are directed into the aperture to engage mating detent cavities in the pivot pin. Alternatively, rotation is restricted away from the pivot pin by mating magnets or by locks in the overlying and underlying table members, which are released prior to rotation.

A second embodiment of this invention incorporates a somewhat more simple sliding mechanism comprising a slide channel and a slide block disposed within the channel and connected to a pivot pin which, in turn, is rigidly secured to the overlying support member. The underlying support member is also rigidly secured to the slide block and, once the overlying support member has been lifted upwardly, and as it is rotated approximately 180°, both the overlying and underlying support members may be slid linearly along the channel as they are guided by the slide block until the pivot pin reaches an approximate center point of the stationary support where it drops into a hole located therein, similar to the first embodiment. The slide block includes slots which receive a stop pin extending from the pivot pin. One slot is a blind slot or partial slot which receives the stop pin when the overlying support member is in its upper, unexpanded position and the other slot is a full length slot which receives the stop pin when the overlying support member is in its lower or flush, expanded position. Aligned holes are also provided in the channel and the stationary support member for receiving the pivot pin when the overlying support member is in either its expanded or unexpanded position. The stationary support member receives the slide channel within a recess and the channel is set just below the upper surface of the stationary support member such that the overlying and underlying support members are supported only by the stationary support member and do not slide along the upper surface of the slide channel.

Because the overlying and underlying support or table members of each embodiment are joined at a single point, the convertible support apparatus of this invention can have a variety of shapes, such as round, square, rectangular, oval, polygonal and the like. Also, the overlying and underlying support members can be produced from a variety of materials, including but not limited to wood, metal, acrylic, laminates, and others. The invention is believed to be particularly beneficial for use in restaurants known typically as "bistros" in which it is desired to have a number of smaller surface area round tables supported on a single base and pedestal. However, the present invention may also be useful in manufacturing many other types of home, shop, office and retail support apparatus and furniture, for example, where an expandable upper support surface is desirable.

Therefore, it is one object of the invention to provide an expandable support apparatus, such as an item of furniture, which has an easily expandable upper surface area.

It is a further object of the invention to provide an expandable support apparatus having a variety of upper support member shapes.

It is yet a further object of the invention to provide a convertible table which has an expanded table surface supportable on either a single pedestal base or a multiple leg base.

These and other objects and advantages of the invention will become readily apparent from the following detailed description of a preferred embodiment of the invention and from the drawings in which:

BRIEF DESCRIPTION OF THE DRAWINGS

FIG. 6 is a cross-sectional view similar to FIG. 4 showing the pivot pin in relation to the underlying and overlying table members with the table surface in the opened or expanded position.

FIGS. 7A, 7B and 7C are alternative embodiments of the pivot pin of the first embodiment.

FIG. 8 is a perspective drawing of an alternative table surface shape, in the opened or expanded position.

FIG. 9 is a perspective drawing of yet another alternative table surface shape, in the opened or expanded position.

DETAILED DESCRIPTION OF THE PREFERRED EMBODIMENTS

In its broader aspects, the invention relates to a support apparatus such as an item of furniture having a surface which is convertible from a first surface area to a larger second surface area comprising a support for supporting a table surface; an underlying support member having an upper support surface; an overlying support member having an upper support surface and positionable above the underlying support member in a first, unexpanded position; and a pivot pin connected to the overlying support member to allow rotation of the overlying support member relative to the underlying support member to thereby expose at least a portion of the upper support surface of the underlying support member. The support apparatus further includes a slide connected to a stationary support. The underlying support member may also be moved translationally along the slide to center the respective upper support surfaces over the stationary support. Finally, the overlying support member may also be moved vertically to allow the two upper support surfaces to become flush with each other.

Figure 1:
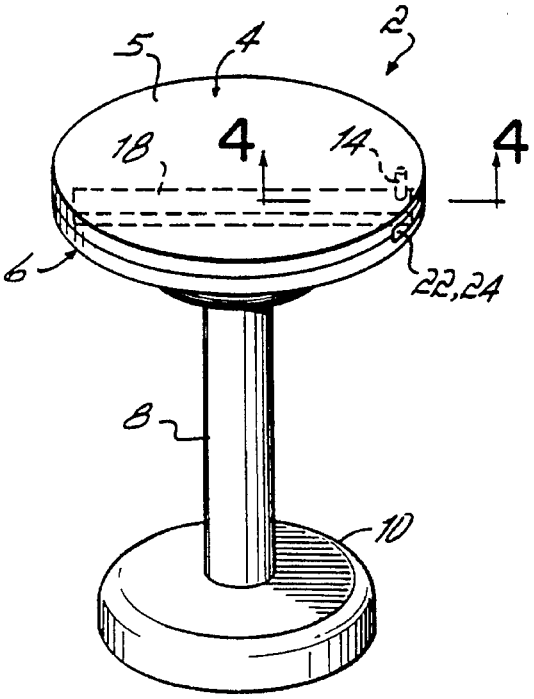
FIG. 1 is a perspective drawing of a first embodiment of a convertible table of the present invention with the table members in the closed or unexpanded position.
Figure 2:
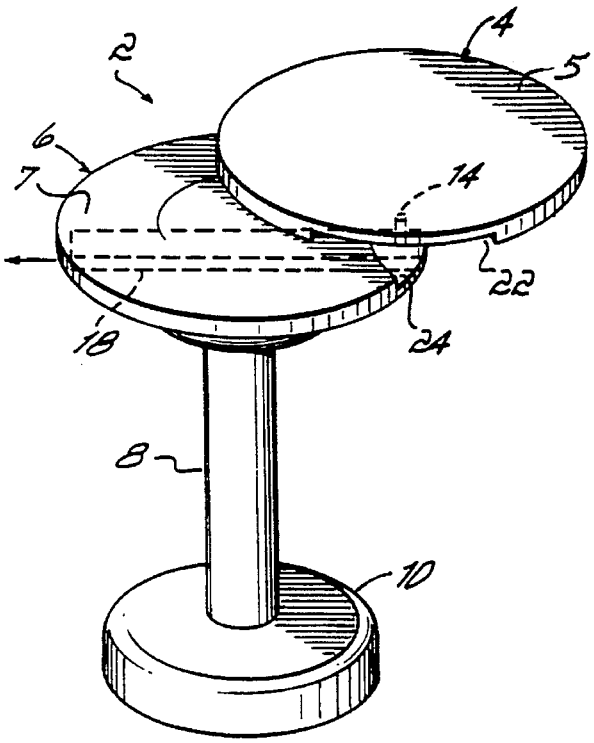
FIG. 2 is a perspective drawing of the convertible table of FIG. 1 with the table members in a partially opened position.
Figure 3:
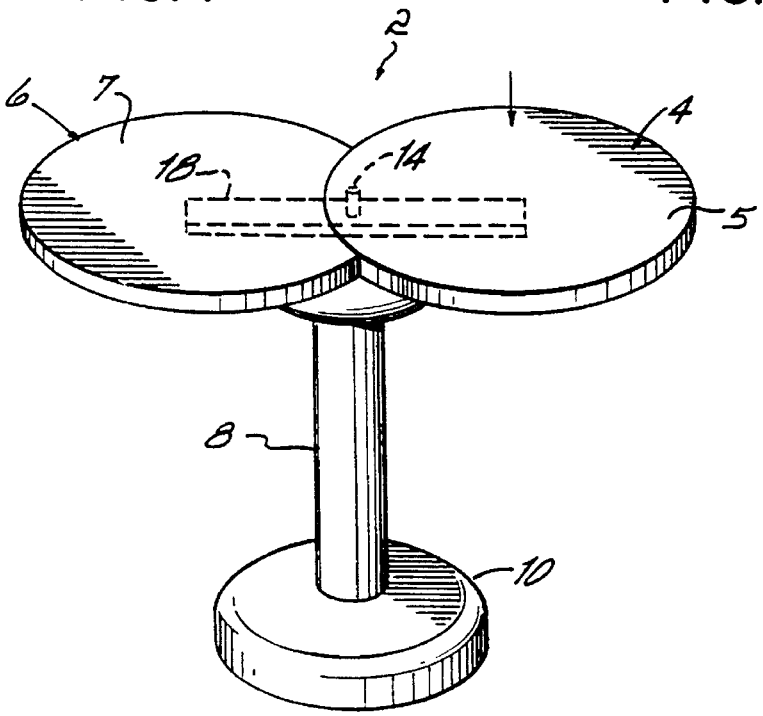
FIG. 3 is a perspective drawing of the convertible table of FIG. 1 with the table members in the open or expanded position.

Referring specifically to the drawings, FIGS. 1, 2 and 3 show a support apparatus, more specifically comprising a convertible table 2 including an overlying table member 4 with table surface 5, underlying table member 6 with table surface 7, pedestal 8 and base 10. The overlying table member 4 and underlying table member 6 are connected via a pivot pin 14, shown in broken lines in FIGS. 1, 2 and 3 and described in more detail below. The underlying table member 6 is connected to the pedestal 8 via slider 18, shown in broken lines in FIGS. 1, 2 and 3 and also described in more detail below.

FIGS. 2 and 3 show respectively the convertible table 2 during the process of rotating the overlying table member 4 relative to the underlying table member 6 to form a table having a larger second table surface area. As discussed further herein, the table will be described as "closed" or "unexpanded" when the overlying table member 4 and underlying table member 6 lie one over the other, as in FIG. 1; "open" or "expanded" as shown in FIG. 3; and in "transition", i.e., in the process of being opened, as shown generally in FIG. 2.

It is desirable to have the respective overlying table member 4 and underlying table member 6 display a flush larger table surface area. To accomplish this, mating portions of the overlying table member 4 and underlying table member 6 are partially cut away so that when the overlying table member 4 is rotated to the open position, its table surface 5 will be able to lie flush with the table surface 7 of underlying table member 6. The cutaway portions 22 and 24 of overlying table member 4 and underlying table member 6 respectively, are shown in FIG. 2, and also in more detail in FIGS. 4, 5 and 6, discussed below.

Figure 4:
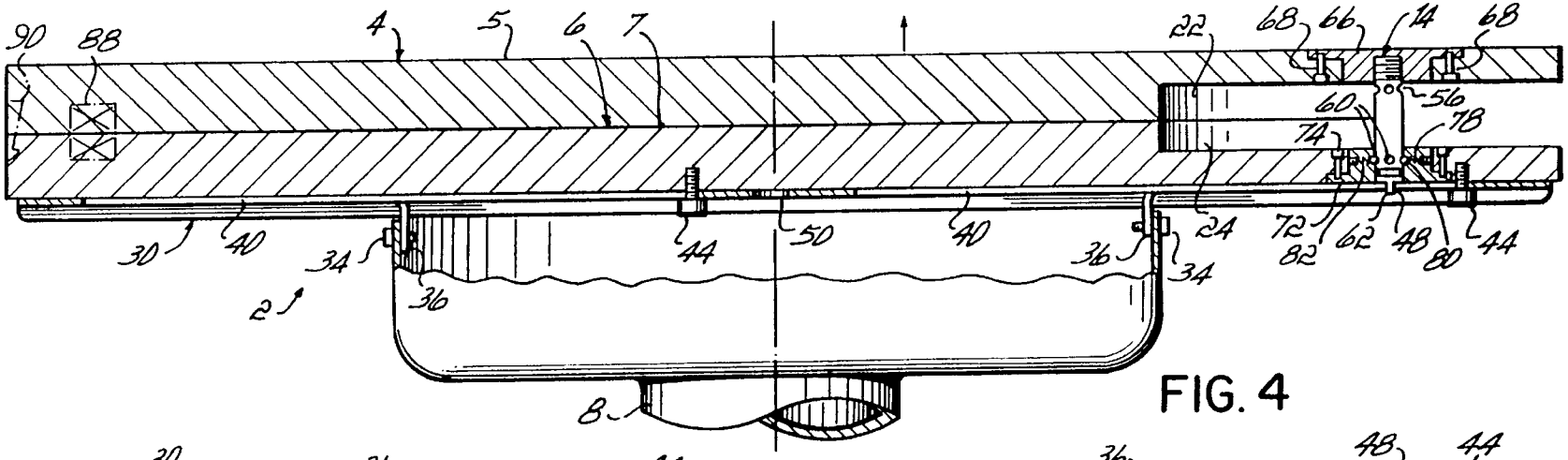
FIG. 4 is a cross-sectional view taken on lines 4—4 of FIG. 1 depicting the underlying and overlying table members, the connecting pivot pin, the slide and stationary support.

FIG. 4 shows the convertible table 2 in the closed position, with overlying table member 4 positioned directly above underlying table member 6. The underlying table member 6 is attached to the pedestal 8 through a slide such as a channel member 30. The channel member 30 is secured to the pedestal 8 by screws 34 fastened through the pedestal 8 and channel member tabs 36.

Figure 4A:
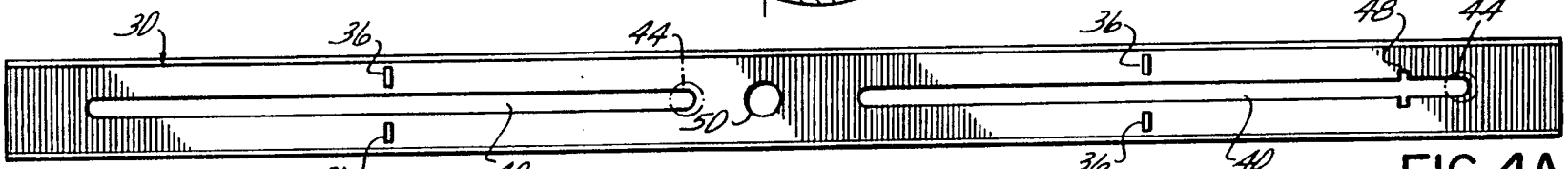
FIG. 4A is a bottom view of the channel member used in the first embodiment as a slide.

As depicted in FIGS. 4 and 4A, the channel member 30 has two slots 40 which receive anchor screws 44 which in turn are driven into the under side of the underlying table member 6 sufficient to retain the underlying table member 6 on the channel member 30, but with enough free play to allow the anchor screws 44 to slide in the slots 40. The heads of anchor screws 44 have a diameter larger than the transverse gap in slots 40 to insure that the underlying table member 6 remains securely connected to the pedestal 8. At the center of channel member 30 is an aperture 50 which has a diameter greater than that of pivot pin 14. One of the slots 40 also has a transverse slot 48, which serves to mate with the pivot pin 14, as discussed in more detail below.

Figure 5:
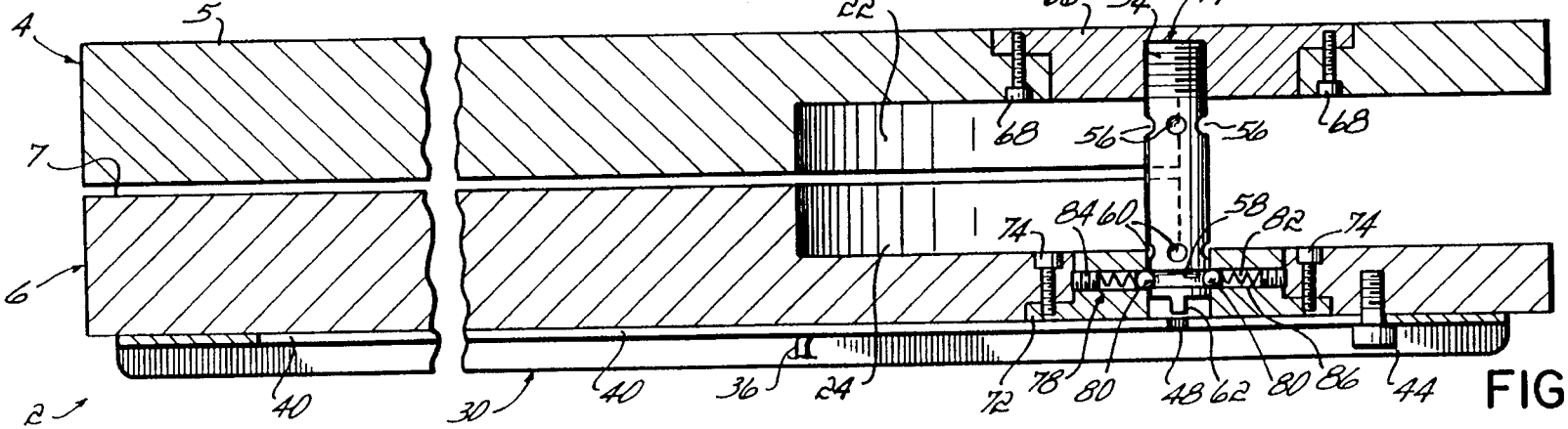
FIG. 5 is a cross-sectional view similar to FIG. 4 showing the pivot pin in relation to the underlying and overlying table members with the table surface in the closed or unexpanded position.

As is shown in FIG. 5, one embodiment of the pivot pin 14 has a threaded end 54, at least one upper detent cavity 56, a race 58 and at least one detent cavity 60 between the upper detent cavity 56 and race 58. At the end opposite the threaded end 54 is a projection 62. The projection has a length essentially equal to the diameter of the first pin 14, but a narrow width, which allows it to mate with the transverse slot 48 of channel member 30. The pivot pin 14 is secured into the overlying table member 4 by inserting the threaded end 54 of the pivot pin 14 into a mating threaded portion of an upper bushing 66 which is secured into table member 4 by flush mounted upper bushing screws 68. The pivot pin 14 is connected to the underlying table member 6 via insertion into lower bushing 72 which in turn is secured into underlying table member 6 by flush mounted lower bushing screws 74. The upper bushing 66 is depicted as spanning the entire thickness of the overlying table member 4 in the vicinity of the pivot pin 14. Such a bushing 66 is necessary for overlying table members 4 constructed from certain materials or where the overlying table member 4 is of a heavier weight. Where it is desired to display a smooth uninterrupted table surface 5, the upper bushing 66 can terminate within the overlying table member 4 at a point below the table surface 5. The bushing 66 may be of smaller dimension, and have a different shape, such as a square receptacle with or without fastening screws only slightly larger than the diameter of the pivot pin 14.

As shown in FIGS. 4, 5 and 6, the lower bushing 72 preferably includes at least one restraining member, such as the ball plunger 78 comprised of a ball 80, a spring 82 and a threaded tensioning device 84 to adjust the spring tension, all located within a bore 86. Bore 86 has threads on the outermost section. The balls 80 are able to be forced into one or more detent cavities 56 or 60. To rotate the overlying table member 4 relative to the underlying table member 6 during transition from closed to open position, the inwardly-directed force on the balls 80 supplied by springs 82 into detent cavities 60 in FIG. 4 must be overcome, both vertically and radially. The spring tension is adjustable by tensioning devices 84 traveling in the threaded sections of bores 86, shown in detail in FIGS. 5 and 6.

To rotate the overlying table member 4 relative to underlying table member 6, the pivot pin 14 is raised within lower bushing 72 so that the lower detent cavities 60 clear the balls 80 and the balls 80 make contact with the race 58, as shown in FIG. 5. At the same time projection 62 will disengage from transverse slot 48 of slot 40 of channel member 30. With the pivot pin 14 in this position, the overlying table member 4 and underlying table member 6 break contact with each other and the overlying table member 4 can be freely rotated during transition without any contact between the overlying table member 4 and the table surface 7 of underlying table member 6.

When the overlying table member 4 is opened to the appropriate position, typically at 180 degrees of rotation of the pivot pin 14, the cutaway portions 22 and 24 respectively of overlying table member 4 and underlying table 6 come into mating alignment (see FIGS. 3 and 6). In this, the open position, the table surface 5 of overlying table member 4 can be brought into flush relation with table surface 7 of the underlying table member 6. This is accomplished by guiding the pivot pin 14 and overlying table member 4 downwardly so that the balls 80 clear both the race 58 and lower detent cavities 60, and engage the upper detent cavities 56. In this position, the rotation of pivot pin 14 is restricted not only by the flush relationship of cutaway portions 22 and 24, but also by the restraining force of balls 80 in the upper detent cavities 56. Where the overlying and underlying table members 4 and 6 are manufactured to very close tolerances, there is essentially no movement of the overlying table member 4 relative to the underlying table member 6 in the open position, independent of the contribution from the contact of balls 80 into upper detent cavities 56.

As shown in FIG. 6 when the pivot pin 14 is lowered relative to the lower bushing 72, the lower portion of the pivot pin 14 is able to extend below the channel member 30. However, the slots 40 are not wide enough to accept the diameter of the pivot pin 14. When pivot pin 14 is positioned over either of the slots 40, the pivot pin 14 cannot travel downward to its full extent, preventing the flush positioning of table surfaces 5 and 7 of the overlying table member 4 and underlying table member 6 respectively. Flush positioning of the table surfaces 5 and 7 can be accomplished only by sliding the underlying table member 6 along channel member 30 until the pivot pin 14 is aligned over the aperture 50 in the channel member 30. Preferably, the anchor screws 44 are so fastened into the under side of underlying table member 6 that the pivot pin 14 will be in alignment over the aperture 50 when the anchor screws 44 make contact with the ends of slots 40, as shown in FIGS. 4A and 6. As the pivot pin 14 drops through aperture 50, the upper detent cavity 56 comes into contact with balls 80 to restrict further radial and vertical movement of the overlying table member 4. By locating the aperture 50 of channel member 30 in a centered position over the pedestal 8 and base 10, the larger second table surface area will have its weight centered over the pedestal 8 and base 10, thus minimizing the risk of tipping the table.

FIGS. 7A, 7B and 7C show alternate embodiments for the pivot pin 14. In FIG. 7A, the pivot pin 14 is similar in configuration to that version shown in FIGS. 4, 5 and 6, except that the projection 62 and upper detent cavities 56 are deleted. Upper detent cavities 56 are not needed where the flush relationship of the overlying and underlying table members 4 and 6 results in minimal free play between the table members. The projection 62, which serves to lock overlying table member 4 in a single position when the table is in closed position, is not as necessary a component where the overlying and underlying table members 4 and 6 have smaller dimension. There would already be provided the restraining effect of contact between lower detent cavities 60 with balls 80 in the FIG. 7A embodiment to maintain the closed position. Further, other means for locking the overlying table member 4 in place away from the pivot pin 14 can be used. Thus, in addition to the restraining effect of the contact between lower detent cavities 60 with balls 80, a lock 90 spanning overlying and underlying table members 4 and 6, or magnets 88, both as shown in broken lines in FIG. 4, can optionally be employed. One such lock 90 can be a thumb latch. The pivot pin 14 of FIG. 7B has no detent cavities at all. Thus a lock 90 or magnet 88 can be used in conjunction with this pivot pin embodiment, keeping in mind that the projection 62 will lock the overlying table member 4 in the closed position, and the flush relationship of overlying and underlying table members 4 and 6 will maintain the larger surface area table in the open position. The pivot pin 14 embodiment in FIG. 7C would require a lock 90 or magnet 88 to hold the overlying and underlying table members 4 and 6 in the closed position because of the absence of the projection 62 and lower detent cavities 60.

Other embodiments for the pivot pin 14 are possible, and are dictated by the features desired. Generally, the projection 62 mating with transverse slot 48 locks the table in closed position. Lower detent cavities 60 restrain movement from the closed position, but do allow movement to occur. Upper detent cavities 56 restrain movement once the open position is attained, but this may not be necessary if the tolerances on the underlying and overlying table members are sufficiently close to minimize relative movement in the flush relationship. The race 58 should be incorporated where it is desired to eliminate contact between the overlying table number 4 and the table surface 7 of underlying table number 6 during transition. An upper race 92, shown in FIGS. 7B and 7C, can be used in place of upper detent cavities 56 where the flush relationship between overlying and underlying table members 4 and 6 results in minimal relative movement about the pivot pin 14, but where it is also desired to restrain vertical movement of the overlying table member 4.

FIGS. 8 and 9 depict alternative designs for convertible tables 2, FIG. 8 depicting an expanded rectangular shape based on two smaller rectangular table members, and FIG. 9 depicting a double diamond effect, again based on two smaller rectangular table members.

The overlying table member 4 and underlying table member 6 may be manufactured from any of a variety of materials, such as wood, engineering plastics such as polycarbonate, other polymeric materials, laminated products, as well as other materials able to be used as a table surface. The pivot pin 14 and various fastening screws disclosed herein have been satisfactorily produced from stainless steel but other materials, such as brass or other metals can be used. Combinations of different materials can be used also. It is also anticipated that, though the embodiment shown in the drawings depicts a support of a single pedestal and base, it is anticipated that other types of frames, such as a more conventional four-leg table frame with a channel member 30 secured thereon, or frames using traditional table leg configurations in, for example, the Early American style, would also be useful.

It is also contemplated that the respective overlying and underlying table members 4 and 6 can be connected via pivot pin 14 in a manner such that the pivot pin 14 is secured into the underlying table member 6, with the restraining member located in the overlying table member 4. The pivot pin 14 in a convertible table so constructed would not be able to drop into a centered aperture below the underlying table member 6, but the table members could still slide along a slider or remain off-center after attaining the open position, so long as the support could maintain the expanded surface in position without tipping.

Figure 10:
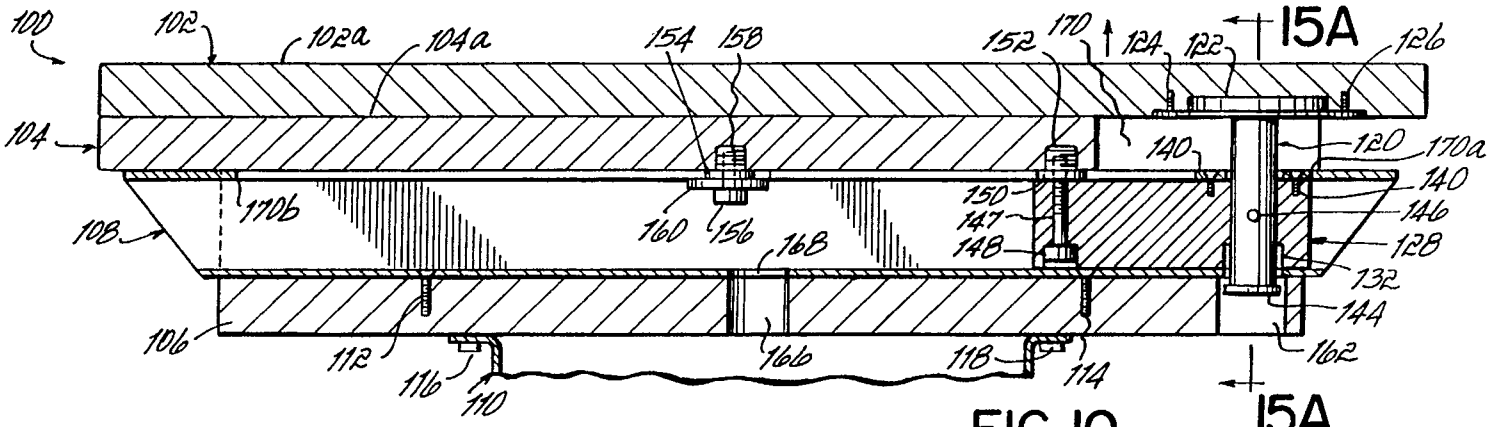
FIG. 10 is a side elevational view in cross section of a table constructed in accordance with a second embodiment of this invention.
Figure 15A:
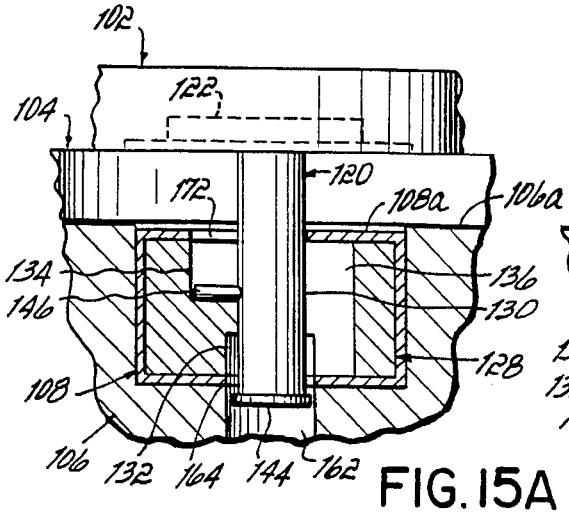
FIG. 15A is a cross sectional view taken along line 15A—15A of FIG. 10.
Figure 15B:
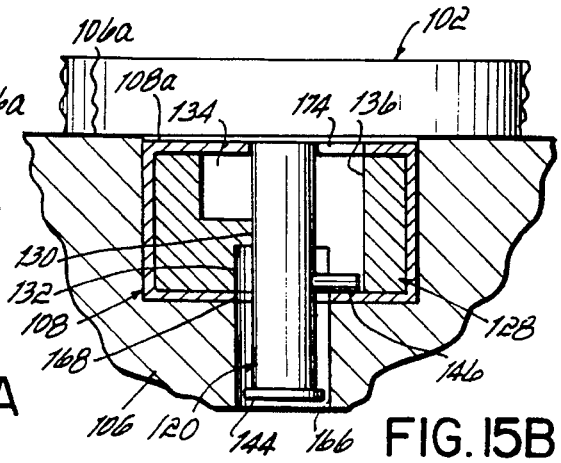
FIG. 15B is a cross sectional view taken along line 15B—15B of FIG. 12.

FIG. 10 illustrates a second embodiment of a convertible support apparatus, specifically comprising a table 100. Table 100 includes an overlying support member or table member 102 having an upper support surface **102*a* and an underlying support member or table member 104 having an upper surface 104*a*. Overlying table member 102 and underlying table member 104 are operatively connected to a stationary support 106 by way of a slide channel 108. Stationary support 106 is rigidly affixed to a suitable base structure 110. Slide channel 108 is fastened to stationary support 106 by fasteners 112, 114 while stationary support 106 is rigidly secured to base 110 by fasteners 116, 118. As shown in FIGS. 15A and 15B, upper surface 108*a* of channel 108 is recessed below upper surface 106*a* of support 106. Overlying table member 102 is pivotally connected to slide channel 108 by a pivot pin 120 which is rigidly secured to the underside of overlying table member 102 by a flange portion 122 of pivot pin 120 which is secured into overlying table member 102 by fasteners 124, 126 only two of which are shown. Pivot pin 120 is pivotally received within a slide block 128 held for sliding movement within channel 108. Slide block 128 may be formed of a variety of materials, including metals, but is preferably formed of a low friction or lubricated plastic material. Channel 108** may be formed of a metal such as aluminum.

Figure 13:
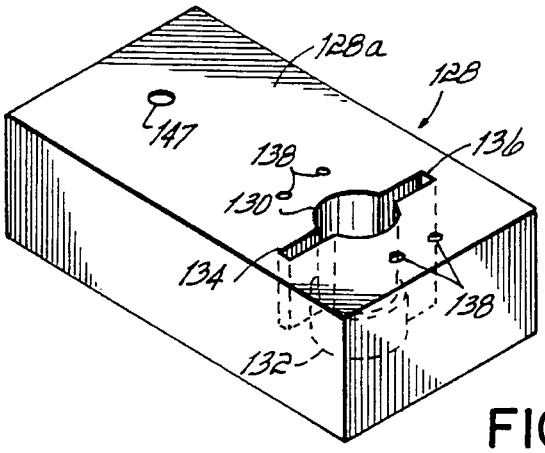
FIG. 13 is a perspective view of the slide block of the second embodiment.

Turning briefly to FIG. 13, slide block 128 includes a bore 130 which opens to upper surface **128*a* of slide block 128 and receives pivot pin 120 (FIG. 10). At a lower end of bore 130 is a counterbore 132 which acts as a stop for arresting upward movement of pivot pin 120 as will be discussed below. First and second slots are provided at 180° positions with respect to bore 130 and each open to bore 130 as well as to upper surface 128*a*. Slot 134 is a blind or partial slot which only extends partially downward into slide block 128 while slot 136 is a full slot which extends all the way through slide block 128. Holes 138 are provided on either side of bore 130 for receiving fasteners 140 which secure a stop plate 142 to the top of slide block 128 (FIG. 10**).

Figure 14:
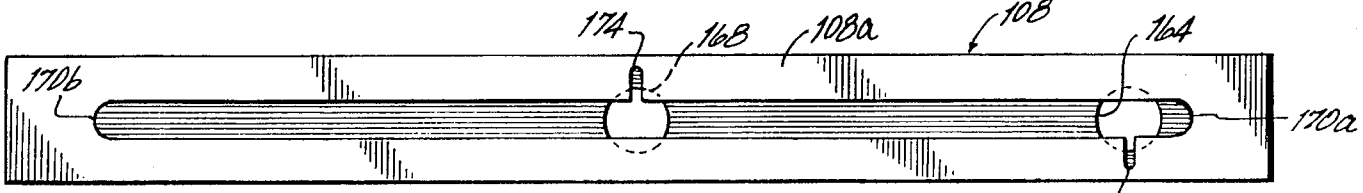
FIG. 14 is a top view of the slide channel of the second embodiment.
Figure 11:
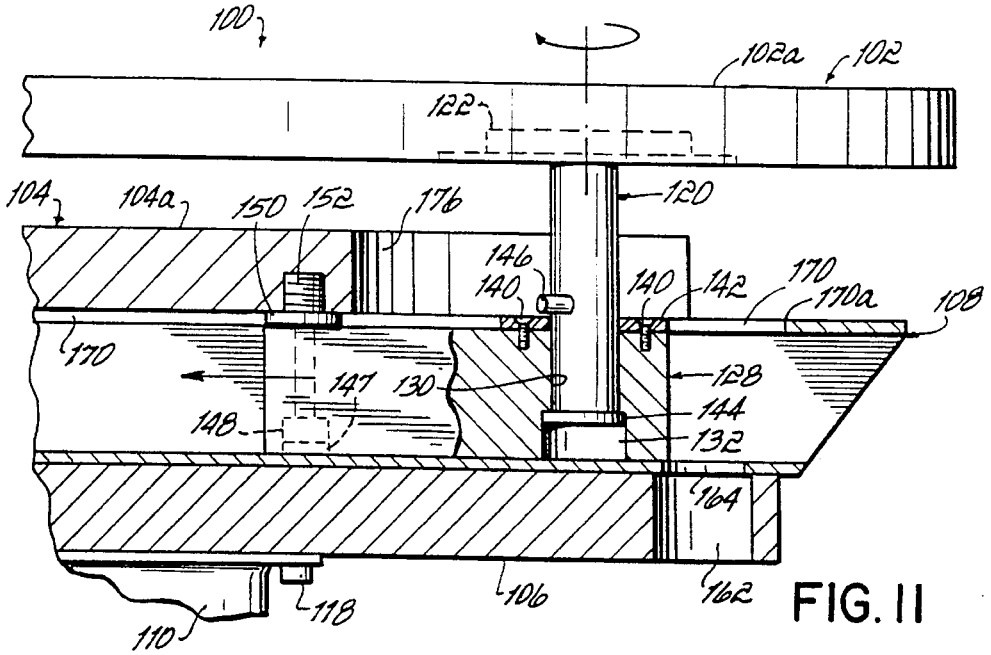
FIG. 11 is a side elevational view partially in cross section, of the table shown in FIG. 10 with the overlying table member being raised upwardly and pivoted into its open or expanded position.

Referring now to FIGS. 10 and 11, pivot pin 120 includes a stop ring or flange 144 at its lower end for arresting the upward movement of pivot pin 120 and overlying table member 102 by contacting the upper end of counterbore 132 as overlying table member 102 is being moved between expanded and unexpanded positions. A stop pin 146 extending outwardly in a transverse direction from pivot pin 120 is provided for registering in slots 134, 136 of slide block 128 (FIG. 13), respectively, in the unexpanded and expanded positions of table 100 as will be discussed below. A hole 147 is also provided in slide block 128 for receiving a fasteners 148 which rigidly secures slide block 128 to a guide member 150. Guide member 150 is rigidly threaded or otherwise secured into underlying support or table member 104 preferably by a threaded portion 152 and slides within a longitudinal slot 170 of channel 108 (see FIG. 14). As further shown in FIG. 10, a second guide member 154 is provided and secured rigidly to underlying support or table member 104 by a fastener 156 and threaded portion 158. Guide member 154 also registers within slot 170 the top of slide channel 108 to guide the sliding linear movement of table member 104. A lower stop ring 160 is provided and also secured to guide member 154. Stop ring 160 is of larger diameter than the width of slot 170 and rides below slot 170 to prevent lifting of table member 104.

Figure 12:
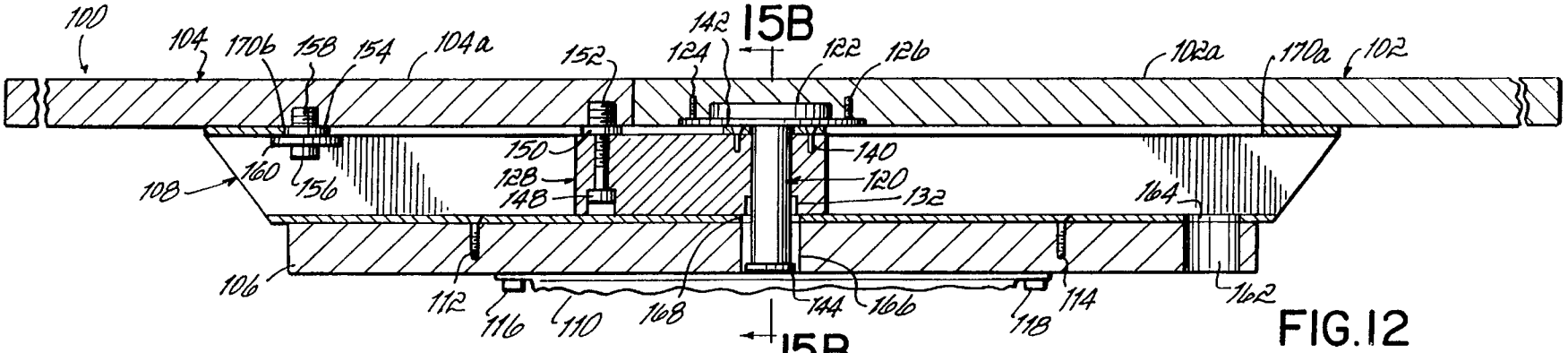
FIG. 12 is a side elevational view in cross section of the table of the second embodiment in its fully expanded and centered position.

Now referring to FIGS. 10–12, which respectively show table 100 in an unexpanded position, an intermediate or transitional position and a fully expanded position, stationary support 106 and slide channel 108 include sets of aligned holes 162, 164 and 166, 168 for respectively receiving pivot pin 120 in the unexpanded position and the expanded position of table 100. As will be appreciated from each of these figures taken in conjunction with FIG. 14, when overlying support or table member 102 has been lifted to the position shown in FIG. 11, pivot pin 120 may slide along upper slot 170 of slide channel 108. As further shown in FIG. 14, slide channel 108 also includes a pair of transverse slots 172, 174 which open to opposite sides of the main longitudinal slot 170 and receive stop pin 146 as overlying table member 102 is respectively raised and lowered when in the unexpanded and expanded positions shown in FIGS. 10 and 12. Finally, as shown best in FIGS. 10, 11 and 16, underlying support or table member 104 may include a cut-out 176 for receiving an edge of overlying table member 102 when table 100 is in a fully expanded position as shown in FIG. 12.

Figure 16:
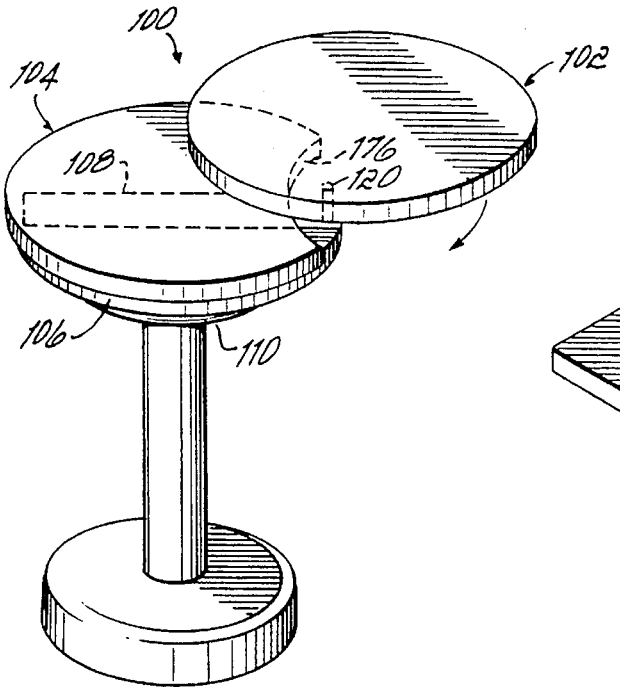
FIG. 16 is a perspective view of a table constructed in accordance with the second embodiment.
Figure 17:
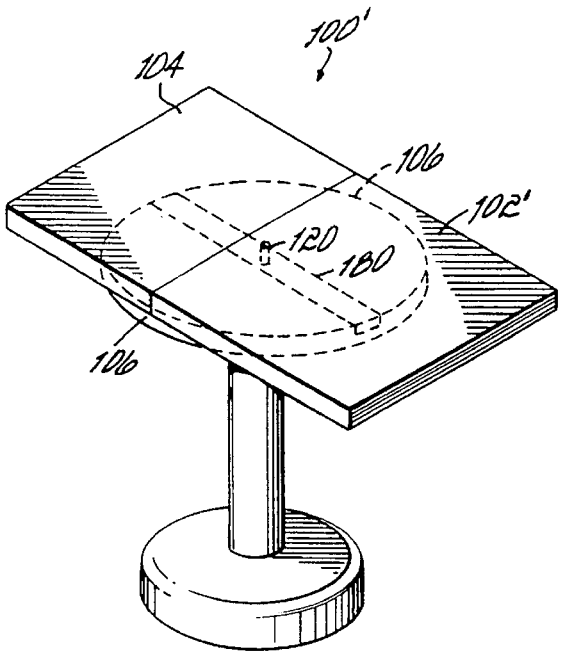
FIG. 17 is a perspective view of an alternative table shape constructed in accordance with the second embodiment.
Figure 18:
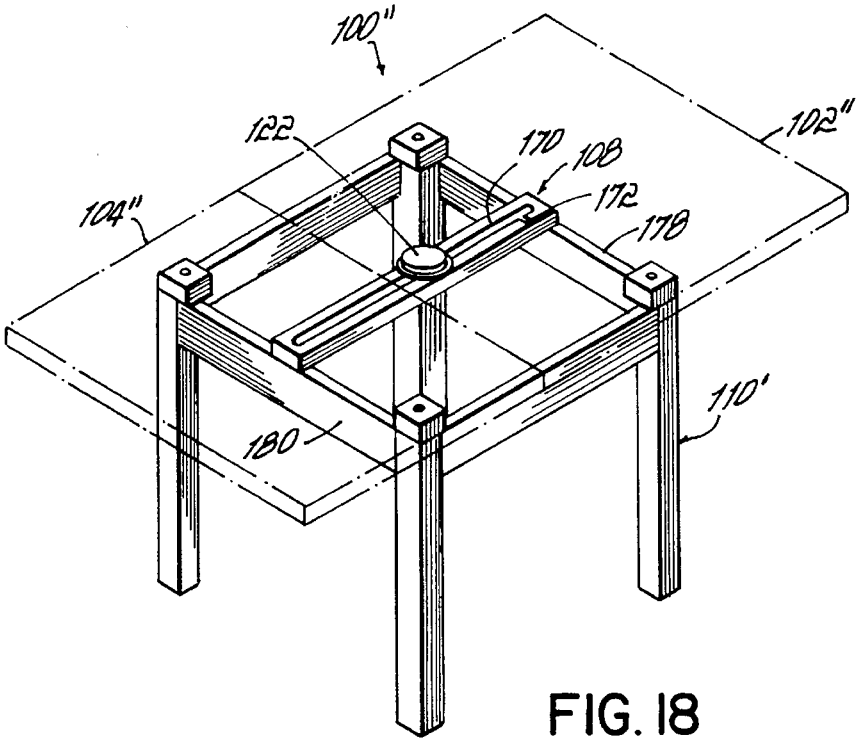
FIG. 18 is a perspective view of still another support apparatus or item of furniture constructed in accordance with the second embodiment of this invention.

FIGS. 16–18 illustrate various alternative constructions of tables 100, 100', 100" which may incorporate the second embodiment of this invention. FIG. 16 essentially illustrates the table shown in FIGS. 10–12, for example, where overlying table member 102, underlying table member 104 and stationary support 106 all comprise generally circular structures, except for cut-out 176 contained in underlying support or table member 104. In this embodiment, base 110 is shown as a pedestal base although other base structures may also be used. FIG. 17 illustrates an example of a table 100' which is similar to table 100 except that overlying and underlying support or table members 102', 104' comprise rectangular structures. Instead of a cut out, underlying table member 104' is made with a shorter longitudinal dimension than overlying table member 102'. FIG. 18 illustrates a third support apparatus 100" similar to the table of FIG. 17, except that a larger, legged base 110' is illustrated as opposed to a pedestal-type base. For this construction, slide channel 108 may be mounted between frame members 178, 180 of legged base 110'.

The operation of table 100 will be best understood from reference to FIGS. 10–12 which respectively show the unexpanded, intermediate and expanded positions of table 100 and FIGS. 15A and 15B which respectively illustrate the position of pivot pin 120 and other pertinent structure in the unexpanded and expanded positions of table 100. In the unexpanded position shown in FIG. 10, overlying table member 102 rests on top of underlying table member 104 with pivot pin 120 extending through bore 130, counterbore 132 and downwardly into hole 162 in stationary support 106. Stop pin 146 is registered within blind slot 134 and stopped at the bottom thereof as shown in FIG. 15A. Stop plate 142 is stopped against end 170*a* of longitudinal slot 170. To expand table 100, overlying support or table member 102 is lifted upwardly until stop pin 146 is raised out of blind slot 134 and slot 172 in channel 108 (FIG. 15A) and then overlying support or table member 102 is rotated about pivot pin 120 as shown in FIG. 11. Preferably as table member 102 is being rotated, table member 102, pivot pin 120, slide block 128, and underlying table member 104, are all moved linearly along channel 108 until guide member 154 contacts end 170*b* of longitudinal slot 170. At this point, overlying table member 102 has been pivoted 180° such that stop pin 146 registers with slot 174 in slide channel 108 and slot 136 in slide block 128 and pivot pin 120 may drop through the full length of slot 136 as shown in FIG. 15B. In this position, slide pin 120 will drop down into hole 166 in stationary support 106 and overlying support or table member 102 will rest on upper surface 106*a* of stationary support 106. Stop pin 146 will be stopped and will rest on the bottom of slide channel 108 as also shown in FIG. 15B. In this position, the upper surfaces 102*a*, 104*a* of overlying support or table member 102 and underlying support or table member 104 will be flush as shown in FIG. 12. Also, pivot pin 120 will be generally located at the center of the combined surfaces 102*a*, 104*a* and at the center of stationary support 106 and base 110.

Having described this invention and its operating parameters, variations may be achieved without departing from the spirit and scope hereof.

What is claimed is:

1. An expandable support apparatus comprising:

a base;

a stationary support connected to said base;

first and second movable support members having respective first and second upper support surfaces, said first movable support member being connected to said stationary support by a vertically, horizontally and rotationally movable pivot and said second movable support member being connected to said stationary support for horizontal movement along said stationary support, said first movable support member being rotatable from an unexpanded position overlying said second movable support to an expanded position adjacent said second movable support, said first and second support members being horizontally movable together toward a central portion of said base, and said first movable support further being movable downwardly in said expanded position to a position in which said first and second upper support surfaces are generally flush with each other.

2. The apparatus of claim 1 wherein said first and second support members are each operatively connected to a movable slide member mounted for linear movement along a slide affixed to said stationary support.

3. The apparatus of claim 2 wherein said slide is a channel and said movable slide member is a slide block disposed for sliding movement within said channel.

4. The apparatus of claim 3 wherein said pivot further comprises a pivot pin rigidly affixed to said first support member and mounted to said slide block for vertical and pivotal movement relative to said slide block.

5. The apparatus of claim 4 wherein said second support member is rigidly connected to said slide block.

6. The apparatus of claim 5 wherein said pivot pin further includes a transversely extending stop pin, said slide block including first and second slots opening to a bore which mounts said pivot pin and positioned to receive said stop pin respectively in said unexpanded and expanded positions.

7. The apparatus of claim 6 wherein said bore includes a stop surface and said pivot pin includes a stop for limiting upward movement of said pivot pin and said first support member when moving said first support member between said expanded and unexpanded positions.

8. The apparatus of claim 2 wherein said pivot further comprises a pivot pin rigidly affixed to said first support member and mounted to said movable slide member for vertical and pivotal movement relative to said movable slide member.

9. The apparatus of claim 8 wherein said second support member is rigidly connected to said movable slide member.

10. The apparatus of claim 2 wherein said slide is recessed below an upper surface of said stationary support such that said second support member rests on the upper surface of said stationary support in said unexpanded position and both said first and second support members rest on the upper surface of said stationary support in said expanded position.

11. The apparatus of claim 1 further comprising a slide affixed to said stationary support including first and second apertures in a bottom surface thereof, and wherein said pivot further comprises a pin, said pin dropping through said first and second openings respectively in said unexpanded and expanded positions to fix said first and second support members with respect to said stationary support in said unexpanded and expanded positions.

12. The apparatus of claim 1 wherein said first and second support members are table tops.

13. An expandable table comprising:

a base;

a stationary support affixed to an upper end of said base;

a slide connected to said stationary support; and, first and second table tops having upper table surfaces, said first table top connected by a vertically, horizontally and rotationally movable pivot connection to said slide and said second table top being connected to said slide for horizontal movement along said slide, said first table top being rotatable by said pivot connection from an unexpanded position overlying said second table top to an expanded position adjacent said second table top, said first and second table tops further being horizontally slidable along said slide to a central, expanded position relative to said base and said first table top being movable vertically downward in said central, expanded position such that the upper table surfaces of said first and second table tops are generally flush with each other.

14. The table of claim 13 wherein said first and second table tops are each operatively connected to a movable slide member mounted for linear movement along said slide.

15. The table of claim 14 wherein said slide is a channel and said movable slide member is a slide block disposed for sliding movement within said channel.

16. The table of claim 15 wherein said pivot further comprises a pivot pin rigidly affixed to said first table top and mounted to said slide block for vertical and pivotal movement relative to said slide block.

17. The table of claim 16 wherein said second table top is rigidly connected to said slide block.

18. The table of claim 17 wherein said pivot pin further includes a transversely extending stop pin, said slide block including first and second slots opening to a bore which mounts said pivot pin and positioned to receive said stop pin respectively in said unexpanded position and said central, expanded position.

19. The table of claim 18 wherein said bore includes a stop surface and said pivot pin includes a stop for limiting upward movement of said pivot pin and said first when moving said first table top between said unexpanded position and said central, expanded position.

20. The table of claim 14 wherein said pivot further comprises a pivot pin rigidly affixed to said first table top and mounted to said movable slide member for vertical and pivotal movement relative to said movable slide member.

21. The table of claim 20 wherein said second table top is rigidly connected to said movable slide member.

22. The table of claim 13 wherein said slide is recessed below an upper surface of said stationary support such that said second table top rests on the upper surface of said stationary support in said unexpanded position and both said first and second table tops rest on the upper surface of said stationary support in said central, expanded position.

23. The table of claim 13 wherein said pivot further comprises a pin and said slide further comprises a channel including first and second apertures in a bottom surface thereof, said pin dropping through said first and second openings respectively in said unexpanded position and central, expanded position to fix said first and second tops with respect to said stationary support in both said positions.

24. An expandable furniture item comprising:

a base;

a stationary support affixed to an upper end of said base; and, first and second support members having upper support surfaces and each being connected to said stationary support, said first support member connected by a vertically and rotationally movable pivot connection to said slide, said first support member being rotatable by said pivot connection from an unexpanded position overlying said second support member to an expanded position adjacent said second support member, said first support member further being movable vertically downward in said expanded position such that the upper support surfaces of said first and second support members are generally flush with each other.

25. The furniture item of claim 24 wherein said furniture item is a table and said first and second support members are table tops.

* * * * *